US012042741B2

(12) United States Patent
Zhang et al.

(10) Patent No.: US 12,042,741 B2
(45) **Date of Patent: *Jul. 23, 2024**

(54) PHOTO BOOTH HAVING SUPPORTING STAGE

(71) Applicant: MARVEL TECHNOLOGY (CHINA) CO., LIMITED, Shenzhen (CN)

(72) Inventors: Shuo Zhang, Shenzhen (CN); Ruru Zhong, Shenzhen (CN)

(73) Assignee: MARVEL TECHNOLOGY (CHINA) CO., LIMITED, Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/506,239

(22) Filed: Nov. 10, 2023

(65) Prior Publication Data

US 2024/0173633 A1 May 30, 2024

Related U.S. Application Data

(63) Continuation-in-part of application No. 18/070,599, filed on Nov. 29, 2022, now Pat. No. 11,852,955.

(30) Foreign Application Priority Data

Nov. 29, 2021 (CN) ..... 202122947239.8

(51) Int. Cl.
*A63G 31/02* (2006.01)
*A63J 1/00* (2006.01)

(52) U.S. Cl.
CPC ..... *A63G 31/02* (2013.01); *A63J 1/00* (2013.01)

(58) Field of Classification Search
None
See application file for complete search history.

(56) References Cited

U.S. PATENT DOCUMENTS 8,317,668 B2 * 11/2012 Sales ..... A63B 21/04 482/146
11,852,955 B2 * 12/2023 Zhang ..... G03B 15/00
2021/0223668 A1 * 7/2021 Wiley, Jr. ..... F16M 11/10

FOREIGN PATENT DOCUMENTS

CN 217561901 U * 10/2022

* cited by examiner

*Primary Examiner* — Rodney E Fuller
(74) *Attorney, Agent, or Firm* — Daniel M. Cohn; Howard M. Cohn

(57) ABSTRACT

A photo booth having a supporting stage includes the supporting stage, a rotatable shooting stand, and a driving assembly. The driving assembly is configured to drive the rotatable shooting stand to circumferentially rotate around the supporting stage. The supporting stage includes an upper cover and a reinforcement frame, and the reinforcement frame includes reinforcement ribs diverging from an central portion of the reinforcement frame to an edge of the reinforcement frame. The upper cover detachably covers the reinforcement frame; or the upper cover covers the reinforcement frame and the upper cover and the reinforcement frame are integrally formed; or the upper cover covers the reinforcement frame and the upper cover is welded to the reinforcement frame. The reinforcement frame includes a supporting ring, supporting rods, and a connecting portion. The supporting ring is generally annular.

10 Claims, 4 Drawing Sheets

PHOTO BOOTH HAVING SUPPORTING STAGE

TECHNICAL FIELD

The present disclosure relates to a technical field of photographic camera devices, and in particular to a photo booth having supporting stage.

BACKGROUND

Nowadays, with the development of technologies, photography and videography have become popular, shooting images is no longer a luxury, and selfie is more casual. Photo booths are 360-degree rotatable shooting platforms and also called 360Photobooth, which are platforms for 360-degree surround shooting. Compared with ordinary selfie devices, the photo booths provide further entertainment experience.

Stage upper covers are a component of the photo booths for users to stand, and in order to ensure structural strength, the stage upper covers of most of the photo booths are manufactured to be thick and heavy, which results in most of the photo booths being too heavy, therefore being inconvenient to transport and high in cost.

SUMMARY

The present disclosure aims to provide a photo booth having a supporting stage to solve the above technical problem for improving a structure of a stage upper cover, thereby solving the technical problems mentioned in the background.

In order to achieve above aims, the present disclosure provides the photo booth having supporting stage, including the supporting stage, a rotatable shooting stand, and a driving assembly. The driving assembly is configured to drive the rotatable shooting stand to circumferentially rotate around the supporting stage. The supporting stage includes an upper cover and a reinforcement frame, and the reinforcement frame is of a divergent configuration from a central portion of the reinforcement frame to an edge of the reinforcement frame.

Furthermore, the upper cover detachably covers the reinforcement frame.

Furthermore, the upper cover covers the reinforcement frame, and the upper cover and the reinforcement frame are integrally formed.

Furthermore, the upper cover covers the reinforcement frame, and the upper cover is welded to the reinforcement frame.

Furthermore, the reinforcement frame includes a supporting ring, and a connecting portion. The supporting ring is generally annular, and the supporting rods and the connecting portion are disposed in a ring of the supporting ring. A first end of each of the supporting rods is connected to an inner wall of the supporting ring, and a second end of each of the supporting rods is connected to the connecting portion.

Furthermore, the supporting rods are uniformly disposed along a circumferential direction of the supporting ring.

Furthermore, the reinforcement frame further includes reinforcement rods, and each of the reinforcement rods is connected to adjacent two of the supporting rods.

Furthermore, the upper cover includes a supporting plate and a ring edge, the ring edge axially extends toward the supporting plate along an outer edge of the supporting plate.

Connecting holes are defined on each of outer walls of the ring edge and the supporting ring.

Furthermore, the photo booth having supporting stage further includes a supporting main shaft. the driving assembly includes a driving motor, a driving wheel, a bearing, and a driven wheel. The driving wheel is disposed at a power output end of the driving motor, the bearing is sleeved on an outer wall of the supporting main shaft, and the driven wheel is sleeved on an outer wall of the bearing. The driving wheel is in transmission connection with the driven wheel, and one end of the rotatable shooting stand is connected to an end surface of the driven wheel.

Furthermore, at least three supporting rods and at least three reinforcement rods are provided.

Compared with the prior art, the present disclosure provides the photo booth having the supporting stage, the supporting stage of which provides the upper cover to detachably cover the reinforcement frame. An upper end surface of the upper cover is a table surface for users to stand, the upper cover may be a thin plate having a proper thickness rather than a solid thick plate, and the reinforcement frame serves as a bearing support of the upper cover, which ensures structural strength of the supporting stage, is safe and durable, and further avoids that an overall weight of the photo booth is heavy. Moreover, when reaching a predetermined durability of the upper cover, the upper cover is required to be replaced with a new one, since the upper cover is detachably connected to the reinforcement frame, the upper cover required to be replaced is separated from the reinforcement frame, and a new upper cover is assembled with the reinforcement frame, which provides great convenience for maintenance of the supporting stage, avoids waste of resources, saves energy, and protects environment.

Figure 1:
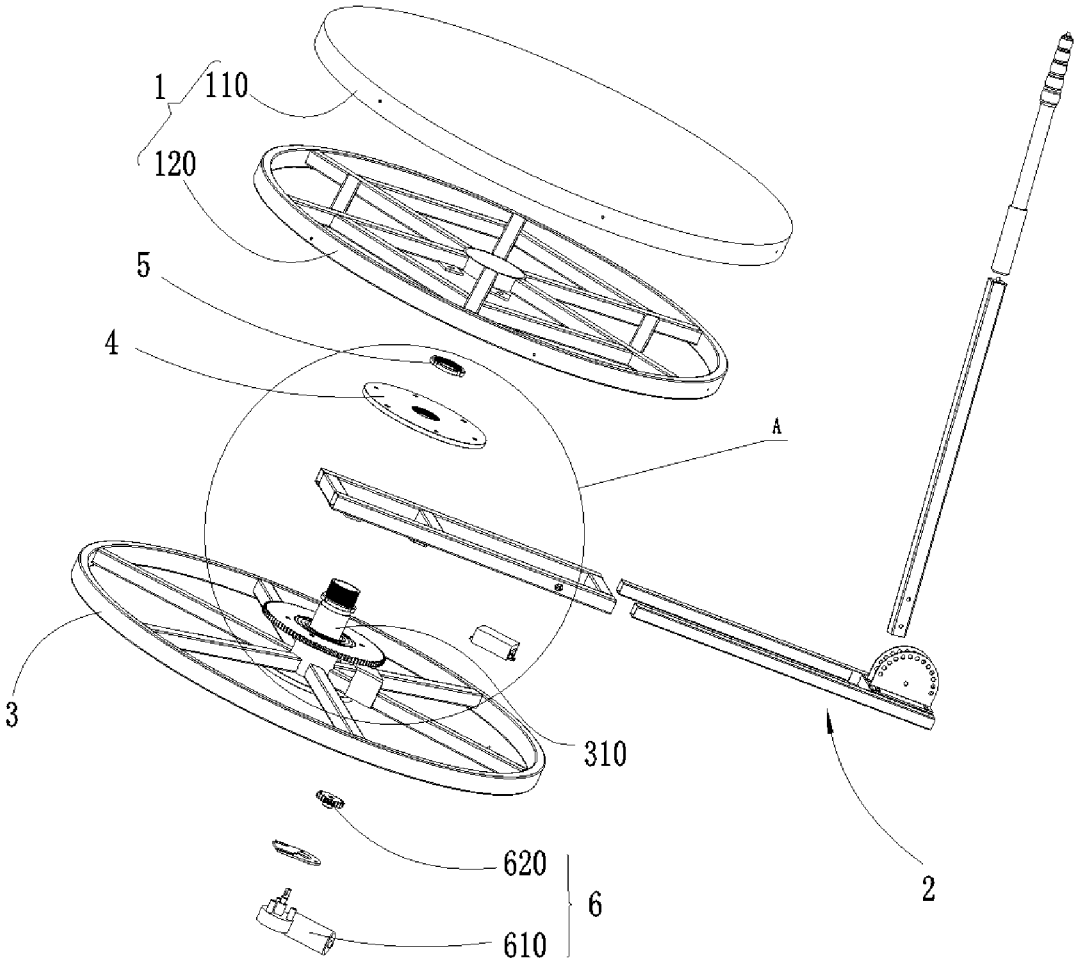
FIG. 1 is an exploded structural schematic diagram of a photo booth having a supporting stage according to one embodiment of the present disclosure.
Figure 2:
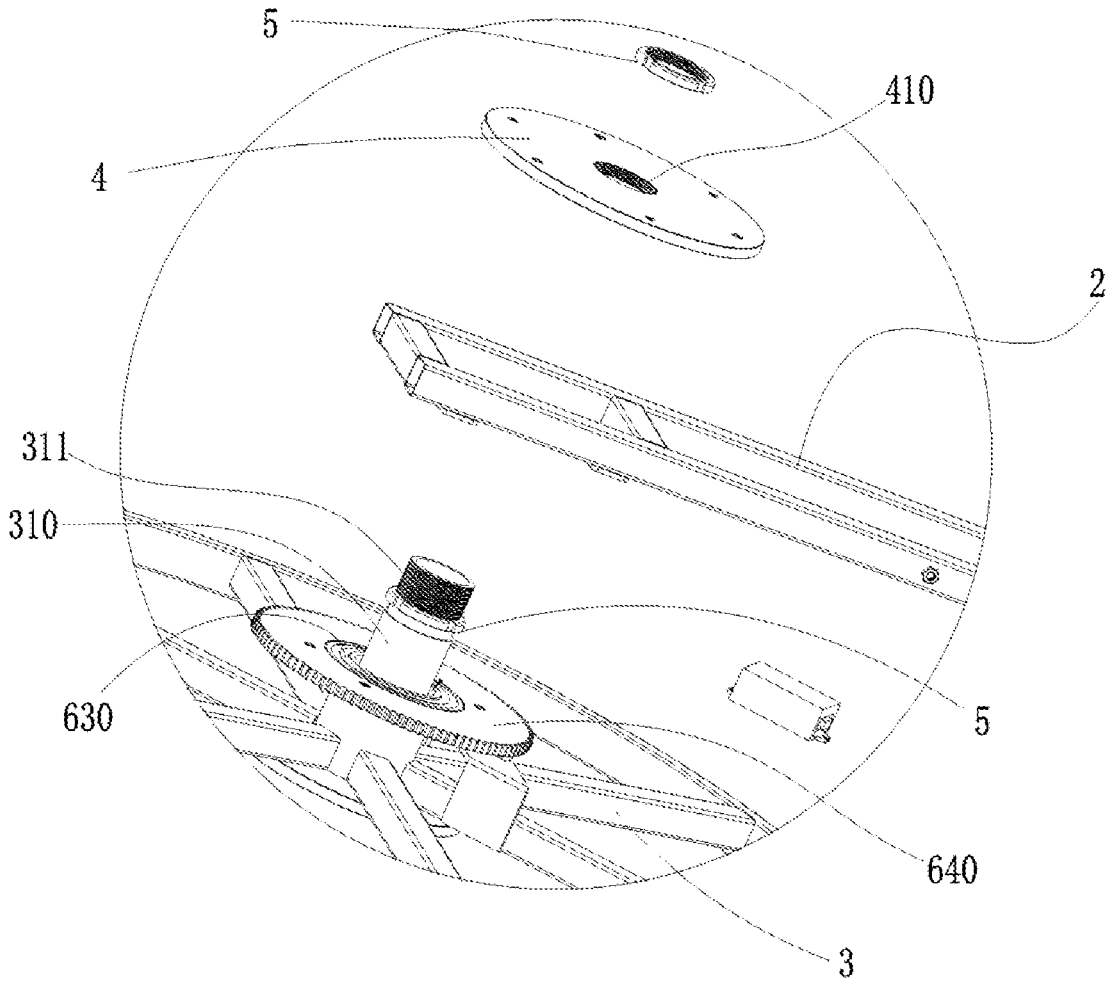
FIG. 2 is an enlarged schematic diagram of portion A shown in FIG. 1.

Reference numerals in the drawings: 1. supporting stage; 110. upper cover; 111. supporting plate; 112. ring edge; 120. reinforcement frame; 121. supporting ring; 122. supporting rod; 123. connecting portion; 124. reinforcement rod; 130. connecting hole; 2. rotatable shooting stand; 3. supporting base; 310. supporting main shaft; 311. outer thread; 4. bottom support; 410. inner thread; 5. fixing nut; 6. driving assembly; 610. driving motor; 620. driving wheel; 630. bearing; and 640. driven wheel.

DETAILED DESCRIPTION OF EMBODIMENTS

As shown in FIGS. 1-4, the present disclosure provides a photo booth having supporting stage, including a supporting stage 1, a rotatable shooting stand 2, and a driving assembly 6. The driving assembly 6 is configured to drive the rotatable shooting stand 2 to circumferentially rotate around the supporting stage 1.

The supporting stage 1 includes an upper cover 110 and a reinforcement frame 120, and the reinforcement frame 120 is of a divergent configuration from a central portion of the reinforcement frame 120 to an edge of the reinforcement frame 120.

Such divergent configuration from the central portion of the reinforcement frame 120 to the edge of the reinforcement frame 120 enables the reinforcement frame 120 have good support strength.

The upper cover 110 detachably covers the reinforcement frame 120.

Currently, the 360Photobooths, that is, the 360-degree rotatable shooting platforms, each is usually provided with only one stage for users to stand. The stage is usually a metal plate, if structural strength of the stage is required to be improved, the metal plate is required to be selected as thick and heavy, which is not only high in cost, but also increases an overall weight of the 360Photobooths and is inconvenient for transportation and carrying. However, if the metal plate is a thin plate, although the cost is reduced and the overall weight is decreased, the metal plate may deform after being treaded by users for multiple times, so that a table surface of the stage is uneven, which is not durable and may easily bring use danger for the users. Moreover, the metal plate is usually assembled and connected with the 360 Photobooth through a welding process, so that the metal plate cannot be conveniently disassembled and replaced, which is inconvenient for maintenance of the 360 Photobooths, and when the stage is damaged, the 360 Photobooth is useless.

The present disclosure provides the photo booth having supporting stage, the supporting stage 1 of which provides the upper cover 110 to detachably cover the reinforcement frame 120. An upper end surface of the upper cover 110 is the table surface for the users to stand, the upper cover 110 may be a thin plate having a proper thickness rather than a solid thick plate, and the reinforcement frame 120 serves as a bearing support of the upper cover 110, which ensures structural strength of the supporting stage 1, is safe and durable, and further avoids that an overall weight of the photo booth is heavy. Moreover, when reaching a predetermined durability of the upper cover 110, the upper cover 110 is required to be replaced with a new one, since the upper cover 110 is detachably connected to the reinforcement frame 120, the upper cover 110 required to be replaced is separated from the reinforcement frame 120, and a new upper cover 110 is assembled with the reinforcement frame 120, which provides great convenience for maintenance of the supporting stage 1, avoids waste of resources, saves energy, and protects environment.

The rotatable shooting stand 2 includes two ends. A first end of the rotatable shooting stand 2 is configured to connect and mount shooting devices, which may clamp and support the shooting devices including external devices of mobile phone supports, cameras, light supplementing lamps, etc. A second end of the rotatable shooting stand 2 is connected to the driving assembly 6, the driving assembly 6 drives the rotatable shooting stand 2 to circumferentially rotate around the supporting stage 1.

In some embodiments, the upper cover 110 covers the reinforcement frame 120, and the upper cover 110 and the reinforcement frame 120 are integrally formed.

The upper cover 110 and the reinforcement frame 120 are integrally formed, and may be manufactured and molded in a 3D printing manner or casting manner. Such structure may also avoid the defect caused by that the metal plate serving as the supporting stage 1 is heavy.

In some embodiments, the upper cover 110 covers the reinforcement frame 120, and the upper cover 110 is welded to the reinforcement frame 120.

The upper cover 110 is welded to the reinforcement frame 12, such structure is high in structural strength and reliability.

Figure 3:
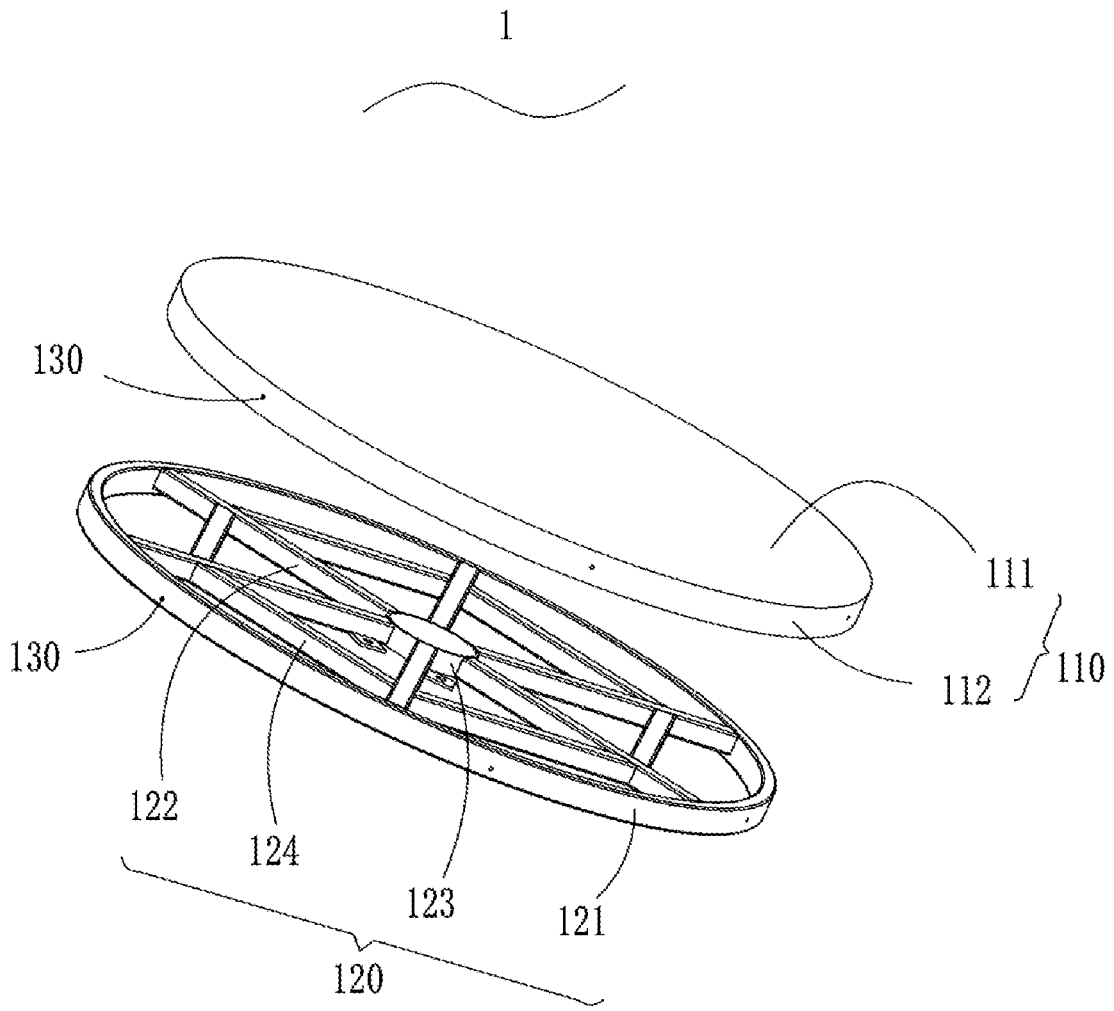
FIG. 3 is an exploded structural schematic diagram of an upper cover of the photo booth having the supporting stage according to one embodiment of the present disclosure.
Figure 4:
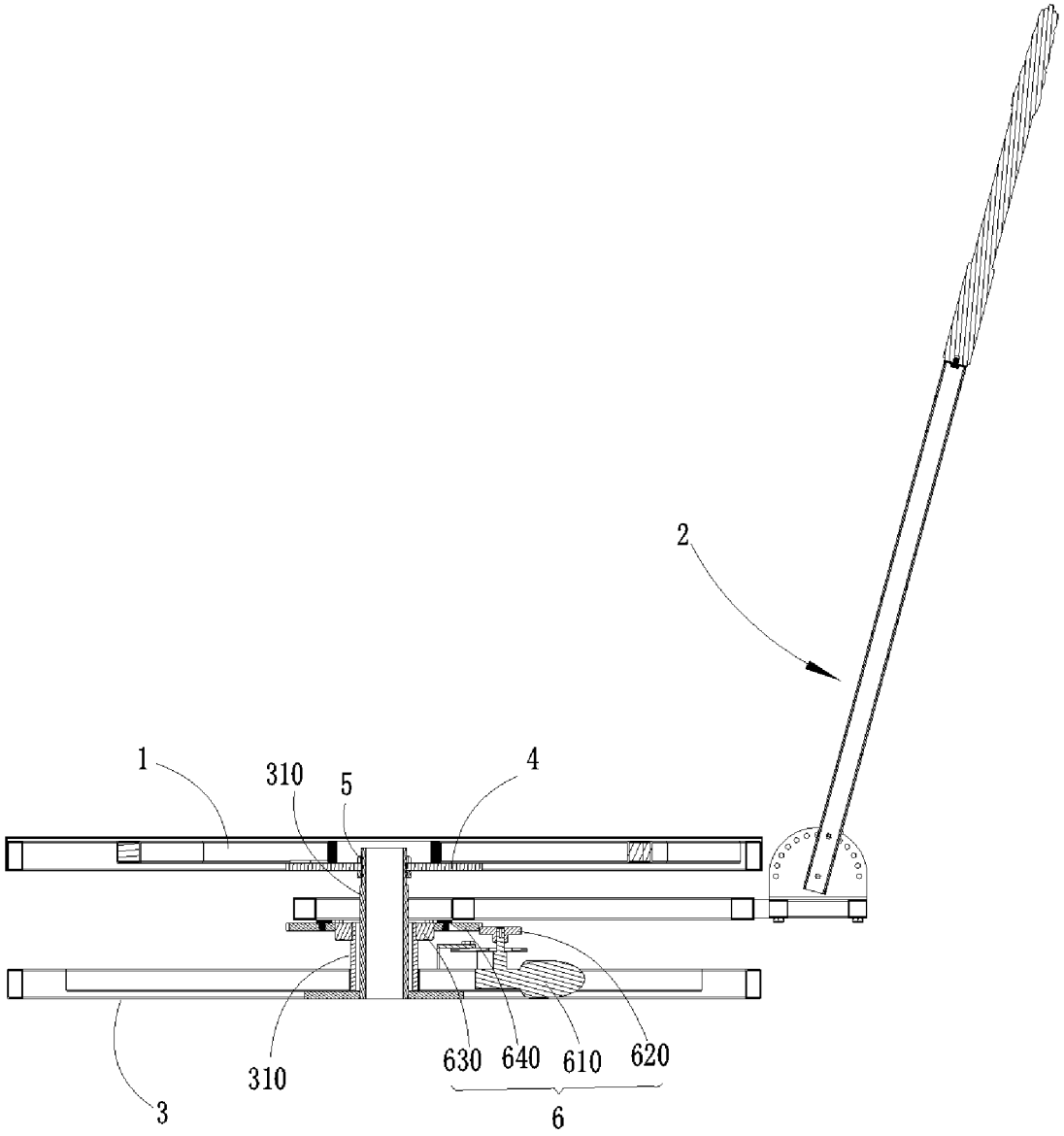
FIG. 4 is a cross-sectional schematic diagram of the photo booth having the supporting stage according to one embodiment of the present disclosure.

As shown in FIGS. 1 and 3, the reinforcement frame 120 includes a supporting ring 121, supporting rods 122, and a connecting portion 123. The supporting ring 121 is generally annular, and the supporting rods 122 and the connecting portion 123 are disposed in a ring of the supporting ring. A first end of each of the supporting rods 122 is connected to an inner wall of the supporting ring 121, and a second end of each of the supporting rods 122 is connected to the connecting portion 123.

The reinforcement frame 120 includes the supporting ring 121, the supporting rods 122, and the connecting portion 123. In some embodiments, the first end of each of the supporting rods 122 is weld to the inner wall of the supporting ring 121, and the second end of each of the supporting rods 122 is weld to the connecting portion 123. As such, adjacent two of the supporting rods 122, an arc-shaped section of the supporting ring 121, and the connecting portion 123 constitute a structure generally in a shape of sector, and the shape of sector is a structure close to triangle, therefore, the reinforcement frame 120 has stronger structural stability.

As shown in FIGS. 1 and 3, the supporting rods 122 are uniformly disposed along a circumferential direction of the supporting ring 121.

In some embodiments, six supporting rods 122 are provided

As shown in FIGS. 1 and 3, the reinforcement frame 120 further includes reinforcement rods 124, and each of the reinforcement rods 124 is connected to adjacent two of the supporting rods 122.

In some embodiments, six reinforcement rods 124 are provided.

In some embodiments, each of the reinforcement rods 124 is connected to adjacent two of the supporting rods 122 through welding, so that structural strength and stability of the reinforcement frame 120 are further enhanced.

As shown in FIGS. 1 and 3, the upper cover 110 includes a supporting plate 111 and a ring edge 112, the ring edge 112 axially extends toward the supporting plate 111 along an outer edge of the supporting plate 111. Connecting holes 130 are defined on each of outer walls of the ring edge 112 and the supporting ring 121. After the upper cover 110 covers the reinforcement frame 120, screws (not shown in the drawings) penetrate the connecting holes 130 to fasten the upper cover 110 and the reinforcement frame 120 for enhancing connection between the upper cover 110 and the reinforcement frame 120.

An accommodation area is defined through the supporting plate 111 and the ring edge 112, and the reinforcement frame 120 is accommodated in the accommodation area. The screws penetrate through the connecting holes on each of the outer walls of the ring edge 112 and the supporting ring 121, and assembly and disassembly between the upper cover 110 and the reinforcement frame 12 are achieved through screwing the screws, therefore providing great convenience for maintenance of the supporting stage 1.

As shown in FIGS. 1-4, the photo booth having the supporting stage further includes a supporting base 3, a bottom support 4, and fixing nuts 5. A supporting main shaft 310 is disposed on an upper end surface of the supporting base 3, and outer threads are disposed on the supporting main shaft 310. The bottom support is connected to a lower bottom surface of the reinforcement frame. The bottom support 4 is sleeved on an outer wall of the supporting main shaft 310, the fixing nuts 5 are disposed on two sides of the bottom support 4 and are connected to the outer threads of the supporting main shaft 311 for clamping and fixing the bottom support 4.

In some embodiments, the bottom support 4 may be provided with inner threads 410 for being in threaded connection with the outer threads of the supporting main shaft 310. The bottom support 4 and the reinforcement frame 120 may be in screw connection or welding connection.

In some embodiments, the connecting portion 123 is generally a hollow cylinder, and an end portion of each of the supporting rods is connected two an outer wall of the hollow cylinder.

The photo booth having the supporting stage further includes a supporting main shaft 310. The driving assembly 6 includes a driving motor 610, a driving wheel 620, a bearing 630, and a driven wheel 640. The driving wheel 620 is disposed at a power output end of the driving motor 610, the bearing 630 is sleeved on an outer wall of the supporting main shaft 310, and the driven wheel 640 is sleeved on an outer wall of the bearing 620. The driving wheel 620 is in transmission connection with the driven wheel 640, and one end of the rotatable shooting stand 2 is connected to an end surface of the driven wheel 640.

In some embodiments, the driving wheel 620 and the driven wheel 640 are all gears, the driving wheel 620 and the driven wheel 640 are engaged with each other, and the driving motor 610 drives the driving wheel 620 to rotate to drive the driven wheel 640 to rotate. Since the one end of the rotatable shooting stand 2 is connected to the end surface of the driven wheel 640, the rotatable shooting stand 2 rotates surrounding the supporting main shaft 310 along with the driven wheel 640. As an improvement, the supporting main shaft 310 is disposed at a center below the supporting stage 310. The bearing 130 plays a role in providing good connection between the driven wheel 640 and the supporting main shaft 310, and further providing smooth rotation for the driven wheel 640 to reduce a friction coefficient.

In some embodiment, the driving wheel 620 and the driven wheel 640 may also be wheels having conveyor belts, and the driving wheel 620 is in transmission connection with the driven wheel 640 through the conveyor belts.

Furthermore, at least three supporting rods 122 and at least three reinforcement rods 142 are provided.

What is claimed is:

1. A photo booth having a supporting stage, comprising:
the supporting stage;
a rotatable shooting stand; and
a driving assembly;
wherein the driving assembly is configured to drive the rotatable shooting stand to circumferentially rotate around the supporting stage; the supporting stage comprises an upper cover and a reinforcement frame the reinforcement frame comprises a connecting portion and supporting rods; a first end of each of the supporting rods is connected to the connecting portion; and the supporting rods are disposed along a circumferential direction of the connecting portion.

2. The photo booth having the supporting stage according to claim 1, wherein the upper cover detachably covers the reinforcement frame.

3. The photo booth having the supporting stage according to claim 1, wherein the upper cover covers the reinforcement frame, and the upper cover and the reinforcement frame are integrally formed.

4. The photo booth having the supporting stage according to claim 1, wherein the upper cover covers the reinforcement frame, and the upper cover is welded to the reinforcement frame.

5. The photo booth having the supporting stage according to claim 1, wherein the reinforcement frame further comprises a supporting ring, the supporting ring is generally annular, and the supporting rods and the connecting portion are disposed in a ring of the supporting ring; a second end of each of the supporting rods is connected to an inner wall of the supporting ring.

6. The photo booth having the supporting stage according to claim 5, wherein the supporting rods are uniformly disposed along a circumferential direction of the supporting ring.

7. The photo booth having the supporting stage according to claim 5, wherein the reinforcement frame further comprises reinforcement rods, and each of the reinforcement rods is connected to adjacent two of the supporting rods.

8. The photo booth having the supporting stage according to claim 7, wherein at least three supporting rods and at least three reinforcement rods are provided.

9. The photo booth having the supporting stage according to claim 1, wherein the upper cover comprises a supporting plate and a ring edge, the ring edge axially extends toward the supporting plate along an outer edge of the supporting plate; connecting holes are defined on each of outer walls of the ring edge and the supporting ring.

10. The photo booth having the supporting stage according to claim 1, wherein the photo booth having supporting stage further comprises a supporting main shaft; the driving assembly comprises a driving motor, a driving wheel, a bearing, and a driven wheel; the driving wheel is disposed at a power output end of the driving motor, the bearing is sleeved on an outer wall of the supporting main shaft, and the driven wheel is sleeved on an outer wall of the bearing; the driving wheel is in transmission connection with the driven wheel, and one end of the rotatable shooting stand is connected to an end surface of the driven wheel.

* * * * *